US005098653A

United States Patent [19]

Shyh-Chin

[11] Patent Number: 5,098,653

[45] Date of Patent: Mar. 24, 1992

[54] TANTALUM AND CHROMIUM CONTAINING TITANIUM ALUMINIDE RENDERED CASTABLE BY BORON INOCULATION

[75] Inventor: Huang Shyh-Chin, Latham, N.Y.

[73] Assignee: General Electric Company, Schenectady, N.Y.

[21] Appl. No.: 546,962

[22] Filed: Jul. 2, 1990

[51] Int. Cl.[5] ..... C22C 14/00

[52] U.S. Cl. ..... 420/418; 420/417; 420/590; 148/421

[58] Field of Search ..... 420/417, 418, 590; 148/421

[56] References Cited

U.S. PATENT DOCUMENTS

| | | | |
|---|---|---|---|
| 3,203,794 | 8/1965 | Jaffee et al. | 420/418 |
| 4,537,742 | 8/1985 | Siemers et al. | 419/8 |
| 4,661,316 | 4/1987 | Hashimoto et al. | 420/418 |
| 4,897,127 | 1/1990 | Huang | 148/421 |
| 4,915,903 | 4/1990 | Brupbacher et al. | 148/407 |

FOREIGN PATENT DOCUMENTS 0298127 12/1989 Japan .

OTHER PUBLICATIONS

Wunderlich et al., Z. Metallkde, 81 (Nov. 1990) 802.

*Primary Examiner*—Upendra Roy
*Attorney, Agent, or Firm*—Paul E. Rochford; James C. Davis, Jr.; James Magee, Jr.

[57] ABSTRACT

A method for providing improved castability in a gamma titanium aluminide is taught. The method involves adding inclusions of boron to the titanium aluminide containing chromium and tantalum. Boron additions are made in concentrations between 0.5 to 2 atomic percent. Fine gain equiaxed microstructure is formed from solidified melt. Property improvements are also achieved.

12 Claims, 3 Drawing Sheets

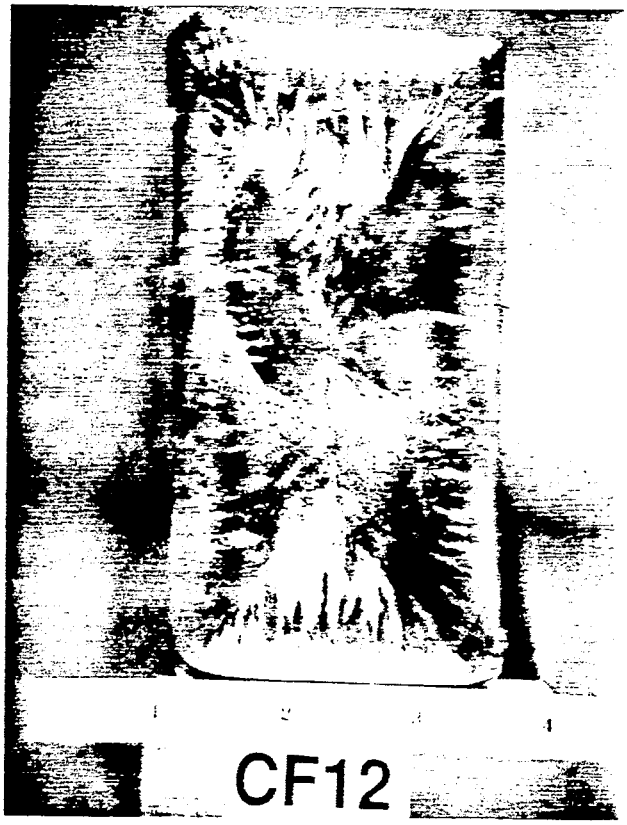
Fig. 2
Fig. 3
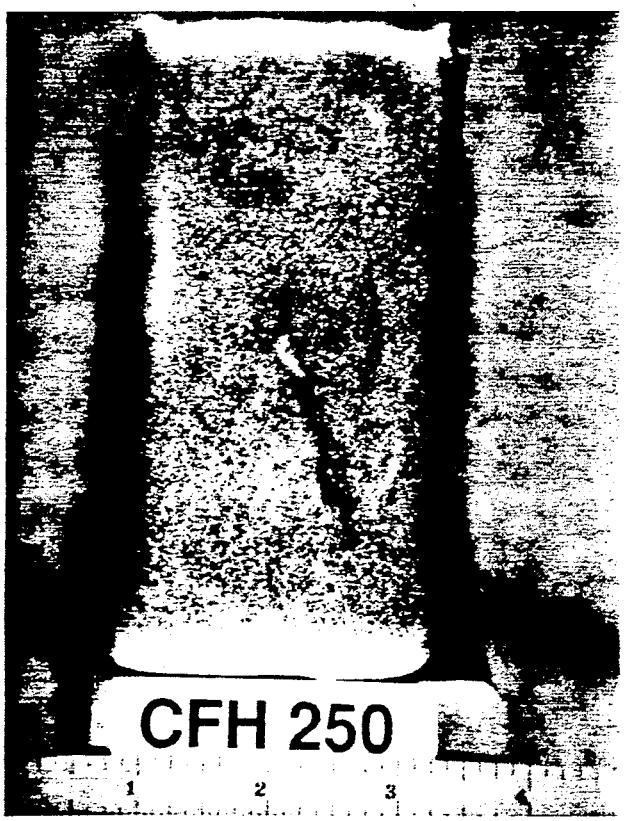

TANTALUM AND CHROMIUM CONTAINING TITANIUM ALUMINIDE RENDERED CASTABLE BY BORON INOCULATION

CROSS REFERENCE TO RELATED APPLICATION

The present invention relates closely to application Ser. No. 07/546973, filed Jul. 20, 1990. The text of the related application is incorporated herein by reference.

BACKGROUND OF THE INVENTION

The present invention relates generally to gamma titanium aluminide (TiAl) alloys having improved castability in the sense of improved grain structure. More particularly, it relates to castings of chromium and tantalum doped TiAl which achieve fine grain microstructure and a set of improved properties with the aid of combined chromium, tantalum, and boron additives.

In forming a casting, it is generally desirable to have highly fluid properties in the molten metal to be cast. Such fluidity permits the molten metal to flow more freely in a mold and to occupy portions of the mold which have thin dimensions and also to enter into intricate portions of the mold without premature freezing. In this regard, it is generally desirable that the liquid metal have a low viscosity so that it can enter portions of the mold having sharp corners and so that the cast product will match very closely the shape of the mold in which it was cast.

Another desirable feature of cast structures is that they have a fine microstructure, that is a fine grain size, so that the segregation of different ingredients of an alloy is minimized. This is important in avoiding metal shrinking in a mold in a manner which results in hot tearing. The occurrence of some shrinkage in a casting as the cast metal solidifies and cools is quite common and quite normal. However, where significant segregation of alloy components occurs, there is a danger that tears will appear in portions of the cast article which are weakened because of such segregation and which are subjected to strain as a result of the solidification and cooling of the metal and of the shrinkage which accompanies such cooling. In other words, it is desirable to have the liquid metal sufficiently fluid so that it completely fills the mold and enters all of the fine cavities within the mold, but it is also desirable that the metal once solidified be sound and not be characterized by weak portions developed because of excessive segregation or internal hot tearing.

With regard to the titanium aluminide itself, it is known that as aluminum is added to titanium metal in greater and greater proportions, the crystal form of the resultant titanium aluminum composition changes. Small percentages of aluminum go into solid solution in titanium and the crystal form remains that of alpha titanium. At higher concentrations of aluminum (including about 25 to 30 atomic percent) and intermetallic compound $Ti_3Al$ forms and has has an ordered hexagonal crystal form called alpha-2. At still higher concentrations of aluminum (including the range of 50 to 60 atomic percent aluminum) another intermetallic compound, TiAl, is formed having an ordered tetragonal crystal form called gamma. The gamma titanium aluminides are of primary interest in the subject application.

The alloy of titanium and aluminum having a gamma crystal form and a stoichiometric ratio of approximately 1, is an intermetallic compound having a high modulus, low density, a high thermal conductivity, a favorable oxidation resistance, and good creep resistance. The relationship between the modulus and temperature for TiAl compounds to other alloys of titanium and in relation to nickle base superalloys is shown in FIG. 1. As is evident from the FIGURE, the gamma TiAl has the best modulus of any of the titanium alloys. Not only is the gamma TiAl modulus higher at higher temperature, but the rate of decrease of the modulus with temperature increase is lower for gamma TiAl than for the other titanium alloys. Moreover, the gamma TiAl retains a useful modulus at temperatures above those at which the other titanium alloys become useless. Alloys which are based on the TiAl intermetallic compound are attractive, light-weight materials for use where high modulus is required at high temperatures and where good environmental protection is also required.

One of the characteristics of gamma TiAl which limits its actual application to such uses is a brittleness which is found to occur at room temperature. Another of the characteristics of gamma TiAl which limits its actual application is a relatively low fluidity of the molten composition. This low fluidity limits the castability of the alloy particularly where the casting involves thin wall sections and intricate structure having sharp angles and corners. Improvements of the gamma TiAl intermetallic compound to enhance fluidity of the melt as well as the attainment of fine microstructure in a cast product are very highly desirable in order to permit more extensive use of the cast compositions at the higher temperatures for which they are suitable. When reference is made herein to a fine microstructure in a cast TiAl product, the reference is to the microstructure of the product in the as-cast condition.

It is recognized that if the product is forged or otherwise mechanically worked following the casting, the microstructure can be altered and may be improved. However, for applications in which a cast product is useful, the microstructure must be attained in the product as cast and not through the application of supplemental mechanical working steps.

What is also sought and what is highly desirable in a cast product is a minimum ductility of more than 0.5%. Such a ductility is needed in order for the product to display an adequate integrity. A minimum room temperature strength for a composition to be generally useful is about 50 ksi or about 350 MPa. However, materials having this level of strength are of marginal utility and higher strengths are often preferred for many applications.

The stoichiometric ratio of gamma TiAl compounds can vary over a range without altering the crystal structure. The aluminum content can vary from about 50 to about 60 atom percent. However, the properties of gamma TiAl compositions are subject to very significant changes as a result of relatively small changes of 1% or more in the stoichiometric ratio of the titanium and aluminum ingredients. Also, the properties are similarly affected by the addition of relatively small amounts of ternary and quaternary elements as additives or as doping agents.

PRIOR ART

There is extensive literature on the compositions of titanium aluminum including the $TiAl_3$ intermetallic compound, the gamma TiAl intermetallic compounds and the $Ti_3Al$ intermetallic compound. A patent, U.S.

Pat. No. 4,294,615, entitled "Titanium Alloys of the TiAl Type" contains an intensive discussion of the titanium aluminide type alloys including the gamma TiAl intermetallic compound. As is pointed out in the patent in column 1, starting at line 50, in discussing the advantages and disadvantages of gamma TiAl relative to $Ti_3Al$:

"It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the gamma alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resembles that of titanium, as the hexagonal crystal structures are very similar. However, the compound TiAl has a tetragonal arrangement of atoms and thus rather different alloying characteristics. Such a distinction is often not recognized in the earlier literature."

A number of technical publications dealing with the titanium aluminum compounds as well as with characteristics of these compounds are as follows:

1. E. S. Bumps, H. D. Kessler, and M. Hansen, "Titanium-Aluminum System", *Journal of Metals*, June, 1952, pp. 609-614, TRANSACTIONS AIME, Vol. 194.
2. H. R. Ogden, D. J. Maykuth, W. L. Finlay, and R. I. Jaffee, "Mechanical Properties of High Purity Ti-Al Alloys", *Journal of Metals*, February, 1953, pp. 267-272, TRANSACTIONS AIME, Vol. 197.
3. Joseph B. McAndrew and H. D. Kessler, "Ti-36 Pct Al as a Base for High Temperature Alloys", *Journal of Metals*, October 1956, pp. 1345-1353, TRANSACTIONS AIME, Vol. 206.
4. S. M. Barinov, T. T. Nartova, Yu L. Krasulin and T. V. Mogutova, "Temperature Dependence of the Strength and Fracture Toughness of Titanium Aluminum", *Izv. Akad, Nuak SSSR*, Met., Vol. 5, 1983, p. 170.

In reference 4, Table I, a composition of titanium-36 aluminum −0.01 boron is reported and this composition is reported to have an improved ductility. This composition corresponds in atomic percent to $Ti_{50}Al_{49.97}B_{0.03}$.

5. H. R. Ogden, D. J. Maykuth, W. L. Finlay, and R. I. Jaffee, "Mechanical Properties of High Purity Ti-Al Alloys", *Journal of Metals*February 1953, pp. 267-272, TRANSACTIONS AIME, Vol. 197.
6. S. M. L. Sastry, and H. A. Lispitt, "Plastic Deformation of TiAl and Ti3Al", *Titanium* 80 (Published by American Society for Metals, Warrendale, Penna.), Vol. 2 (1980) page 1231.
7. Patrick L. Martin, Madan G. Mendiratta, and Harry A. Lispitt, "Creep Deformation of TiAl and TiAl+W Alloys", *Metallurgical Transactions A*, Vol. 14A (October 1983) pp. 2171-2174.
8. Tokuzo Tsujimoto, "Research, Development, and Prospects of TiAl Intermetallic Compound Alloys", *Titanium and Zirconium*, Vol. 33, No. 3, 159 (July 1985) pp. 1-13.
9. H. A. Lispitt, "Titanium Aluminides—An Overview", *Mat. Res. Soc. Symposium Proc.*, Materials Research Society, Vol. 39 (1985) pp. 351-364.
10. S. H. Whang et al., "Effect of Rapid Solidification in $Ll_0$TiAl Compound Alloys", ASM Symposium Proceedings on Enhanced Properties in Struc. Metals Via Rapid Solidification, *Materials Week* (October 1986) pp. 1-7.
11. Izvestiya Akademii Nauk SSR, *Metally*. No. 3 (1984) pp. 164-168.
12. P. L. Martin, H. A. Lispitt, N. T. Nuhfer and J. C. Williams, "The Effects of Alloying on the Microstructure and Properties of $Ti_3Al$ and TiAl", *Titanium* 80 (published by the American Society of Metals, Warrendale, Penna.), Vol. 2 (1980) pp. 1245-1254.
13. D. E. Larsen, M. L. Adams, S. L. Kampe, L. Christodoulou, and J. D. Bryant, "Influence of Matrix Phase Morphology on Fracture Toughness in a Discontinuously Reinforced XD™ Titanium Aluminide Composite", *Scripta Metallurgica et Materialia*, Vol. 24, (1990) pp. 851-856.
14. J. D. Bryant, L. Christodon, and J. R. Maisano, "Effect of $TiB_2$ Additions on the Colony Size of Near Gamma Titanium Aluminides", *Scripta Metallurgica et Materialia*, Vol. 24 (1990) pp. 33-38.

A number of other patents also deal with TiAl compositions as follows:

U.S. Pat. No. 3,203,794 to Jaffee discloses various TiAl compositions.

Canadian Patent 621884 to Jaffee similarly discloses various compositions of TiAl.

U.S. Pat. No. 4,661,316 (Hashimoto) teaches titanium aluminide compositions which contain various additives.

U.S. Pat. No. 4,842,820, assigned to the same assignee as the subject application, teaches the incorporation of boron to form a tertiary TiAl composition and to improve ductility and strength.

U.S. Pat. No. 4,639,281 to Sastry teaches inclusion of fibrous dispersoids of boron, carbon, nitrogen, and mixtures thereof or mixtures thereof with silicon in a titanium base alloy including Ti-Al.

European patent application 0275391 to Nishiejama teaches TiAl compositions containing up to 0.3 weight percent boron and 0.3 weight percent boron when nickel and silicon are present. No chromium or tantalum is taught to be present in a combination with boron.

BRIEF DESCRIPTION OF THE INVENTION

It is, accordingly, one object of the present invention to provide a method of casting gamma TiAl intermetallic compound into bodies which have a fine grain structure.

Another object is to provide a method which permits gamma TiAl castings to be formed with a fine grain structure and a desirable combination of properties.

Another object is to provide a method for casting gamma TiAl into structures having reproducible fine grain structure.

Another object is to provide castings of gamma TiAl which have a desirable set of properties as well as a fine microstructure.

Other objects and advantages of the present invention will be in part apparent and in part pointed out in the description which follows.

In one of its broader aspects, the objects of the present invention can be achieved by providing a melt of a gamma TiAl containing between 43 and 48 atom percent aluminum between 1.0 and 6.0 atom percent tantalum and between 0 and 3.0 atom percent chromium, adding boron as an inoculating agent at concentrations of between 0.5 and 2.0 atom percent, and casting the melt.

BRIEF DESCRIPTION OF THE DRAWINGS

The description which follows will be understood with greater clarity if reference is made to the accompanying drawings in which:

FIG. 2 is a micrograph of a casting of Ti-48Al (Example 2).

FIG. 3 is a micrograph of a casting of Ti-45.5Al-2Cr-Ta-1B (Example 14).

DETAILED DESCRIPTION OF THE INVENTION

Figure 1:
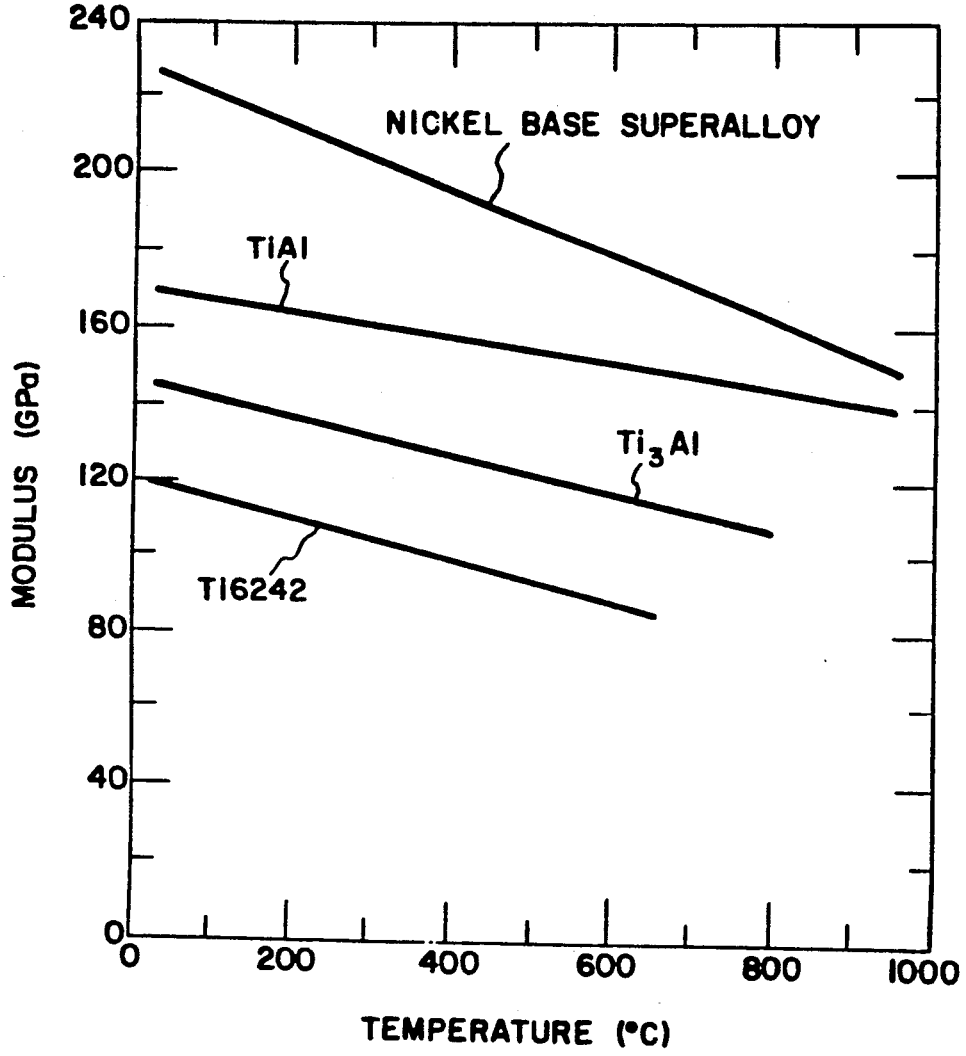
FIG. 1 is a graph illustrating the relationship between modulus and temperature for an assortment of alloys.
Figure 4:
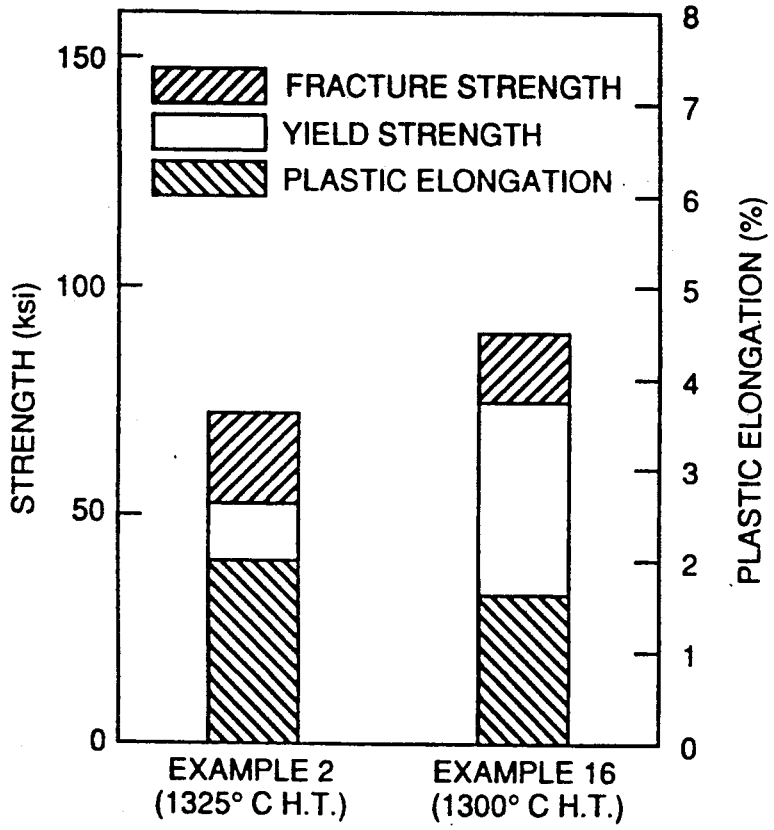
FIG. 4 is a bar graph illustrating the property differences between the alloys similar to those of FIGS. 2 and 3.

It is well known, as is extensively discussed above, that except for its brittleness the intermetallic compound gamma TiAl would have many uses in industry because of its light weight, high strength at high temperatures and relatively low cost. The composition would have many industrial uses today if it were not for this basic property defect of the material which has kept it from such uses for many years.

Further, it has been recognized that cast gamma TiAl suffers from a number of deficiencies some of which have also be discussed above. These deficiencies include the absence of a fine microstructure; the absence of a low viscosity adequate for casting in thin sections; the brittleness of the castings which are formed; the relatively poor strength of the castings which are formed; and a low fluidity in the molten state adequate to permit castings of fine detail and sharp angles and corners in a cast product.

The inventor has now found that substantial improvements in the castability of gamma TiAl and substantial improvements in the cast products can be achieved by modifications of the casting practice as now herein discussed.

To better understand the improvements in the properties of gamma TiAl, a number of examples are presented and discussed here before the examples which deal with the novel processing practice of this invention.

EXAMPLES 1-3

Three individual melts were prepared to contain titanium and aluminum in various binary stoichiometric ratios approximating that of TiAl. Each of the three compositions was separately cast in order to observe the microstructure. The samples were cut into bars and the bars were separately HIPed (hot isostatic pressed) at 1050° C. for three hours under a pressure of 45 ksi. The bars were then individually subjected to different heat treatment temperatures ranging from 1200° to 1375° C. Conventional test bars were prepared from the heat treated samples and yield strength , fracture strength and plastic elongation measurements were made. The observations regarding solidification structure, the heat treatment temperatures and the values obtained from the tests are included in Table I.

TABLE I

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 1 | Ti—46Al | large equiaxed | 1200 | 49 | 58 | 0.9 |
| | | | 1225 | * | 55 | 0.1 |
| | | | 1250 | * | 56 | 0.1 |
| | | | 1275 | 58 | 73 | 1.8 |
| 2 | Ti—48Al | columnar | 1250 | 54 | 72 | 2.0 |
| | | | 1275 | 51 | 66 | 1.5 |
| | | | 1300 | 56 | 68 | 1.3 |
| | | | 1325 | 53 | 72 | 2.1 |
| 3 | Ti—50Al | columnar-equiaxed | 1250 | 33 | 42 | 1.1 |
| | | | 1325 | 34 | 45 | 1.3 |
| | | | 1350 | 33 | 39 | 0.7 |
| | | | 1375 | 34 | 42 | 0.9 |

* - specimens failed elastically

As is evident from Table I, the three different compositions contain three different concentrations of aluminum and specifically 46 atomic percent aluminum; 48 atomic percent aluminum; and 50 atomic percent aluminum. The solidification structure for these three separate melts are also listed in Table I, and as is evident from the table, three different structures were formed on solidification of the melt. These differences in crystal form of the castings confirm in part the sharp differences in crystal form and properties which result from small differences in stoichiometric ratio of the gamma TiAl compositions. The Ti-46Al was found to have the best crystal form among the three castings but small equiaxed form is preferred.

Regarding the preparation of the melt and the solidification, each separate ingot was electroarc melted in an argon atmosphere. A water cooled hearth was used as the container for the melt in order to avoid undesirable melt-container reactions. Care was used to avoid exposure of the hot metal to oxygen because of the strong affinity of titanium for oxygen.

Bars were cut from the separate cast structures. These bars were HIPed and were individually heat treated at the temperatures listed in the Table I.

The heat treatment was carried out at the temperature indicated in the Table I for two hours.

From the test data included in Table I, it is evident that the alloys containing 46 and 48 atomic percent aluminum had generally superior strength and generally superior plastic elongation as compared to the alloy composition prepared with 50 atomic percent aluminum. The alloy having the best overall ductility was that containing 48 atom percent aluminum.

However, the crystal form of the alloy with 48 atom percent aluminum in the as cast condition did not have a desirable cast structure inasmuch as it is generally desirable to have fine equiaxed grains in a cast structure in order to obtain the best castability in the sense of having the ability to cast in thin sections and also to cast with fine details such as sharp angles and corners.

EXAMPLES 4-6

The present inventor found that the gamma TiAl compound could be substantially ductilized by the addition of a small amount of chromium. This finding is the subject of a U.S. Pat. No. 4,842,819.

A series of alloy compositions were prepared as melts to contain various concentrations of aluminum together with a small concentration of chromium. The alloy compositions cast in these experiments are listed in Table II immediately below. The method of preparation is essentially that described with reference to Examples 1-3 above.

TABLE II

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 4 | Ti—46Al—2Cr | large equiaxed | 1225 | 56 | 64 | 0.5 |
| | | | 1250 | 44 | 53 | 1.0 |
| | | | 1275 | 50 | 59 | 0.7 |
| 5 | Ti—48Al—2Cr | columnar | 1250 | 45 | 60 | 2.2 |
| | | | 1275 | 47 | 63 | 2.1 |
| | | | 1300 | 47 | 62 | 2.0 |
| | | | 1325 | 53 | 68 | 1.9 |
| 6 | Ti—50Al—2Cr | columnar-equiaxed | 1275 | 50 | 60 | 1.1 |
| | | | 1325 | 50 | 63 | 1.4 |
| | | | 1350 | 51 | 64 | 1.3 |
| | | | 1375 | 50 | 58 | 0.7 |

The crystal form of the solidified structure was observed and, as is evident from Table II the addition of chromium did not improve the mode of solidification of the structure of the materials cast and listed in Table I. In particular, the composition containing 46 atomic percent of aluminum and 2 atomic percent of chromium had large equiaxed grain structure. By way of comparison, the composition of Example 1 also had 46 atomic percent of aluminum and also had large equiaxed crystal structure. Similarly for Examples 5 and 6, the addition of 2 atomic percent chromium to the composition as listed in Examples 2 and 3 of Table I showed that there was no improvement in the solidification structure.

Bars cut from the separate cast structures were HIPed and were individually heat treated at temperatures as listed in Table II. Test bars were prepared from the separately heat treated samples and yield strength, fracture strength and plastic elongation measurements were made. In general, the material containing 46 atomic percent aluminum was found to be somewhat less ductile than the materials containing 48 and 50 atomic percent aluminum but otherwise the properties of the three sets of materials were essentially equivalent with respect to tensile strength.

It will be noted as well that the composition containing 48 atomic percent aluminum and 2 atomic percent chromium had the best overall set of properties. In this sense, it is similar to the composition containing 48 atom percent aluminum of Example 2. However, the addition of chromium did not improve the ductility of the cast material as it did the compositions of the U.S. Pat. No. 4,842,819 prepared by other metal processing.

EXAMPLES 7-9

Melts of three additional compositions of gamma TiAl were prepared, the compositions of which are listed in Table III immediately below. The preparation was according to the procedures described above with reference to Examples 1-3 For convenience of reference, the composition and test data of Example 2 is copied into Table III. Elemental boron was mixed into the charge to be melted to make up the boron concentration of each boron containing alloy.

TABLE III

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 2 | Ti—48Al | columnar | 1250 | 54 | 72 | 2.0 |
| | | | 1275 | 51 | 66 | 1.5 |
| | | | 1300 | 56 | 68 | 1.3 |
| | | | 1325 | 53 | 72 | 2.1 |
| 7 | Ti—48Al—0.1B | columnar | 1275 | 53 | 68 | 1.5 |
| | | | 1300 | 54 | 71 | 1.9 |
| | | | 1325 | 55 | 69 | 1.7 |
| | | | 1350 | 51 | 65 | 1.2 |
| 8 | Ti—48Al—2Cr—2Ta—0.2B | columnar | 1275 | 62 | 82 | 2.1 |
| | | | 1300 | 61 | 82 | 2.5 |
| | | | 1325 | 62 | 80 | 1.8 |
| 9 | Ti—47Al—2Cr—3TA—0.1B | columnar | 1250 | 70 | 80 | 0.6 |
| | | | 1275 | 77 | 91 | 1.3 |

TABLE III-continued

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| | | | 1300 | 69 | 90 | 2.0 |
| | | | 1325 | 83 | 97 | 1.1 |

As is evident from the results listed in Table III, the addition of low concentrations of boron of the order of 0.1 or 0.2 atomic percent does not result in alteration of the crystal form of the solidified TiAl base compositions.

The applicant had discovered that the properties of TiAl base compositions can be advantageously modified by addition of a small amount of tantalum to the TiAl as well as by the addition of a small amount of chromium plus tantalum to the TiAl. These discoveries are the subject U.S. Pat. No. 4,842,817, and of copending application Ser. No. 375,074, filed July 3, 1989, the texts of which are incorporated herein by reference.

Although the crystal form of the solidified gamma TiAl containing chromium and tantalum was not altered by the addition of 0.2 atomic percent of boron the tensile properties of the composition were dramatically improved with particular reference to tensile strength and ductility.

EXAMPLES 10–13

Melts of four additional compositions of gamma TiAl were prepared with compositions as listed in Table IV immediately below. The preparation was according to the procedures described above with reference to Examples 1–3. In Examples 12 and 13, as in Examples 7–9, the boron concentrations were added in the form of elemental boron into the melting stock.

TABLE IV

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 4 | Ti—46Al—2Cr | large equiaxed | 1225 | 56 | 64 | 0.5 |
| | | | 1250 | 44 | 53 | 1.0 |
| | | | 1275 | 50 | 59 | 0.7 |
| 10 | Ti—46Al—2Cr—0.5C | columnar | 1250 | 97 | 97 | 0.2 |
| | | | 1300 | 86 | 86 | 0.2 |
| | | | 1350 | 69 | 73 | 0.3 |
| | | | 1400 | 96 | 100 | 0.3 |
| 11 | Ti—46.5Al—2Cr—0.5N | fine, equiaxed | 1250 | + | 77 | 0.1 |
| | | | 1300 | 73 | 75 | 0.2 |
| | | | 1350 | + | 60 | 0.1 |
| | | | 1400 | + | 80 | 0.1 |
| 12 | Ti—45.5Al—2Cr—1B | fine, equiaxed | 1250 | 77 | 85 | 0.5 |
| | | | 1275 | 76 | 85 | 0.7 |
| | | | 1300 | 75 | 89 | 1.0 |
| | | | 1325 | 71 | 80 | 0.5 |
| | | | 1350 | 78 | 85 | 0.4 |
| 13 | Ti—45.25Al—2Cr—1.5B | fine, equiaxed | 1250 | 81 | 88 | 0.5 |
| | | | 1300 | 79 | 85 | 0.4 |
| | | | 1350 | 83 | 94 | 0.7 |

+ - specimens failed elastically

Again, following the formation of each of the melts of the four examples, observation of the solidification structure was made and the structure description is recorded in Table IV. The data for Example 4 is copied into Table IV to make comparison of data with the Ti-46Al-2Cr composition more convenient. In addition, bars were prepared from the solidified sample, the bars were HIPed, and given individual heat treatments at temperatures ranging from 1250° to 1400° C. Tests of yield strength, fracture strength and plastic elongation are also made and these test results are included in Table IV for each of the specimens tested under each Example.

It will be noted that the compositions of the specimens of the Examples 10–13 corresponded closely to the composition of the sample of Example 4 in that each contained approximately 46 atomic percent of aluminum and 2 atomic percent of chromium. Additionally, a quaternary additive was included in each of the examples. For Example 10, the quaternary additive was carbon and as is evident from Table IV the additive did not significantly benefit the solidification structure inasmuch as a columnar structure was observed rather than the large equiaxed structure of Example 4. In addition, while there was an appreciable gain in strength for the specimens of Example 10, the plastic elongation was reduced to a sufficiently low level that the samples were essentially useless.

Considering next the results of Example 11, it is evident that the addition of 0.5 nitrogen as the quaternary additive resulted in substantial improvement in the solidification structure in that it was observed to be fine equiaxed structure. However, the loss of plastic elongation meant that the use of nitrogen was unacceptable because of the deterioration of tensile properties which it produced.

Considering the next Examples 12 and 13, here again, the quaternary additive, which in both cases was boron, resulted in a fine equiaxed solidification structure thus improving the composition with reference to its castability. In addition, a significant gain in strength resulted from the boron addition based on a comparison of the values of strength found for the samples of Example 4 as stated above. Also very significantly, the plastic elongation of the samples containing the boron quaternary additive were not decreased to levels which rendered the compositions essentially useless. Accordingly, I have found that by adding boron to the titanium aluminide containing the chromium ternary additive I am able not only to substantially improve the solidification structure, but am also able to significantly improve tensile properties including both the yield strength and fracture strength without unacceptable loss of plastic elongation. I have discovered that beneficial results are obtainable from additions of higher concentrations of boron where the concentration levels of aluminum in the titanium aluminide are lower. Thus the gamma titanium aluminide composition containing chromium and boron additives are found to very significantly improve the castability of the titanium aluminide based composition particularly with respect to the solidification structure and with respect to the strength properties of the composition. The improvement in cast crystal form occurred for the alloy of Example 13 as well as of Example 12. However, the plastic elongation for the alloy of Example 13 were not as high as those for the alloy of Example 12.

EXAMPLE 14

One additional alloy composition was prepared having ingredient content as set forth in Table V immediately below. The method of preparation was essentially as described in Examples 1-3 above. As in the earlier examples, elemental boron was mixed into the charge to be melted to make up the boron concentration of each boron containing alloy.

occurred from the addition of carbon as employed in Example 10, or from the use of the nitrogen additive as employed in Example 11.

It will be appreciated that our testing has shown that the copending alloy containing tantalum and chromium additives (Ser. No. 375,074, filed July 3, 1989) is a highly desirable alloy because of the combination of properties and specifically the improvement of the properties of the TiAl which is attributed to the inclusion of the tantalum and chromium additives. However, it is also evident from the above that the crystal form of an alloy containing the chromium and tantalum is basically columnar and is not in the preferred finely equiaxial crystal form desired for casting applications. Accordingly, the base alloy containing the chromium and tantalum additives has a desirable combination of properties which may be attributed to the presence of the chromium and tantalum. In addition, because of the infusion of boron into the base alloy, the crystal form of the alloy, and its castability, is very dramatically improved. But, at the same time, there is no significant loss of the unique set of properties which are imparted to the base TiAl alloy by the chromium and tantalum additives. From the study of the influence of several additives such as carbon and nitrogen above, it is evident that it is the combination of additives which yields the unique set of desirable results. Numerous other combinations, including one containing nitrogen, for example, suffer significant loss of properties although gaining a beneficial crystal form.

TABLE V

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 14 | Ti—45.5Al—2Cr—1B—2Ta | fine, equiaxed | 1225 | 76 | 92 | 1.1 |
| | | | 1250 | 69 | 87 | 1.2 |
| | | | 1275 | 70 | 85 | 0.9 |
| | | | 1300 | 68 | 82 | 0.9 |

As is evident from Table V, the composition of Example 14 is essentially the compositions of Example 12 to which 2 atomic percent of tantalum has been added.

Again, following the description given in Examples 1-3, the solidification structure was examined after the melt of this compositions had been cast. The solidification structure found was the fine equiaxed form which had also been observed for the sample of Example 12.

Following the steps set forth with reference to Examples 1-3, bars of the cast material were prepared, HIPed, and individually heat treated at the temperatures listed in Table V. The test bars were prepared and tested and the results of the tests are listed in Table V with respect to both strength properties and with respect to plastic elongation. As is evident from the data listed in Table V, significant improvements particularly in plastic elongation were found to be achievable employing the composition as set forth in Example 14 of Table V. The compositions of the samples of Example 14 correspond closely with respect to the combined chromium and tantalum additives to compositions disclosed in copending application Ser. No. 360,664, filed June 2, 1989. The conclusions drawn from the findings of Example 14 are that the boron additive greatly improves the castability of the composition of the copending application referenced immediately above.

Accordingly, it is apparent that not only does the cast material have the desirable fine equiaxed form, but the strength of the compositions of Examples 14 is greatly improved over the composition of Examples 1, 2, and 3 of Table I. In addition the plastic elongation of the samples of Example 14 is not significantly reduced as

What is claimed is:

1. A castable composition having a fine, equiaxed microstructure in the as-cast state comprising titanium, aluminum, chromium, tantalum, and boron in the following approximate composition:

$$Ti_{41-55.5}Al_{43-48}Cr_{0-3}Ta_{1-6}B_{0.5-2.0}.$$

2. A castable composition having a fine, equiaxed microstructure in the as-cast state comprising titanium, aluminum, chromium, tantalum, and boron in the following approximate compositions:

$$Ti_{41.5-55}Al_{43-48}Cr_{0-3}Ta_{1-6}B_{1.0-1.5}.$$

3. A castable composition having a fine, equiaxed microstructure in the as-cast state comprising titanium, aluminum, chromium, tantalum, and boron in the following approximate composition:

$$Ti_{43-53.5}Al_{43-48}Cr_{1-3}Ta_{2-4}B_{0.5-2.0}.$$

4. A castable composition having a fine, equiaxed microstructure in the as-cast state comprising titanium, aluminum, chromium, tantalum, and boron in the following approximate composition:

$$Ti_{46-50.5}Al_{44.5-46.5}Cr_{2}Ta_{2-4}B_{1.0-1.5}.$$

5. A castable composition having a fine, equiaxed microstructure in the as-cast state comprising titanium, aluminum, chromium, tantalum, and boron in the following approximate composition:

$Ti_{47-51.5}Al_{44.5-46.5}Cr_{1-3}Ta_2B_{1.0-1.5}$.

6. A castable composition having a fine, equiaxed microstructure in the as-cast state comprising titanium, aluminum, chromium, tantalum, and boron in the following approximate composition:

$Ti_{48-50.5}Al_{44.5-46.5}Cr_2Ta_2B_{1.0-1.5}$.

7. A structural element, said element being a casting having a fine, equiaxed microstructure in the as-cast state and formed of a composition having the following approximate composition:

$Ti_{41.5-55}Al_{43-48}Cr_{0-3}Ta_{1-6}B_{0.5-2.0}$.

8. A structural element, said element being a casting having a fine, equiaxed microstructure in the as-cast state and formed of a composition having the following approximate compositions:

$Ti_{41.5-55}Al_{43-48}Cr_{0-3}Ta_{1-6}B_{1.0-1.5}$.

9. A structural element, said element being a casting having a fine, equiaxed microstructure in the as-cast state and formed of a composition having the following approximate compositions:

$Ti_{43-53.5}Al_{43-48}Cr_{1-3}Ta_{2-4}B_{0.5-2.0}$.

10. A structural element, said element being a casting having a fine, equiaxed microstructure in the as-cast state and formed of a composition having the following approximate composition:

$Ti_{46-50.5}Al_{44.5-46.5}Cr_2Ta_{2-4}B_{1.0-1.5}$.

11. A structural element, said element being a casting having a fine, equiaxed microstructure in the following approximate composition:

$Ti_{47-51.5}Al_{44.5-46.5}Cr_{1-3}Ta_2B_{1.0-1.5}$.

12. A structural element, said element being a casting having a fine, equiaxed microstructure in the as-cast state and formed of a composition having the following approximate compositions:

$Ti_{48-50.5}Al_{44.5-46.5}Cr_2Ta_2B_{1.0-1.5}$.

* * * * *